US006042387A

United States Patent [19]

Jonaidi

[11] Patent Number: 6,042,387

[45] Date of Patent: Mar. 28, 2000

[54] CONNECTOR, CONNECTOR SYSTEM AND METHOD OF MAKING A CONNECTOR

[75] Inventor: Siamak Jonaidi, San Jose, Calif.

[73] Assignee: Oz Technologies, Inc., Hayward, Calif.

[21] Appl. No.: 09/049,802

[22] Filed: Mar. 27, 1998

[51] Int. Cl.[7] ..... H01R 9/09; H01R 1/00

[52] U.S. Cl. ..... 439/66; 439/71

[58] Field of Search ..... 439/71, 66, 591, 439/91, 82, 81, 83; 361/769

[56] References Cited

U.S. PATENT DOCUMENTS

| | | | |
|---|---|---|---|
| 5,015,191 | 5/1991 | Grabbe et al. . | |
| 5,152,695 | 10/1992 | Grabbe et al. | 439/71 |
| 5,173,055 | 12/1992 | Grabbe | 439/66 |
| 5,228,861 | 7/1993 | Grabbe | 439/66 |
| 5,629,837 | 5/1997 | Barabi et al. . | |
| 5,632,631 | 5/1997 | Fjelstad et al. | 439/82 |
| 5,812,378 | 9/1998 | Fjelstad et al. | 361/769 |

*Primary Examiner*—Renee S. Luebke
*Assistant Examiner*—Chandrika Prasad
*Attorney, Agent, or Firm*—Donald L. Beeson

[57] ABSTRACT

A connector system (20) connects a leadless integrated circuit (IC) device (22) to a printed circuit (PC) board (24) by means of a contact array (26). The contact array (26) connects input-output (I/O) contacts on the IC device (22) to corresponding circuit contacts (28) on PC board (24). The contact array (26) is a generally thin, flexible and rectangular shaped element that is sandwiched between the PC board (24) and the IC device (22). The contact array (26) has a plurality of square cells (30) that are each a portion of the array (26) and are formed from a planar body (32) of a suitable conductive material, such as beryllium copper, sandwiched between suitable insulating films, formed from polyimide. Each cell is divided into a first pair (34) of contact elements (36) extending above the plane of the body (32) and a second pair (38) of contact elements (36) extending below the plane of the body (32).

9 Claims, 14 Drawing Sheets

CONNECTOR, CONNECTOR SYSTEM AND METHOD OF MAKING A CONNECTOR

BACKGROUND OF THE INVENTION

1. Field of the Invention

The present invention relates generally to interconnect technology. More particularly, it relates to a form of interconnect technology that is usable both for testing integrated circuits and for permanently interconnecting in solderless connections with the integrated circuits at a system level on a printed circuit (PC) board. Most especially, in a preferred form, the invention relates to an improved form of contacts and contact arrays described or claimed in commonly assigned Barahi et al., U.S. Pat. No. 5,629,837, issued May 13, 1997.

2. Description of the Prior Art

The contacts and contact arrays in the above referenced issued patent represent a significant advance in contact structure intended primarily for electrical test applications. The contacts and contact arrays of that patent are particularly well able to withstand repeated insertion and withdrawal of integrated circuits from a test fixture incorporating them.

An aspect of the contacts and contact arrays of the Barahi et al. patent is that the embodiment disclosed there, while suitable from a cost standpoint to fabrication in limited quantities for test fixtures, is too expensive for use in high volume production for permanently interconnecting with integrated circuits on PC boards. Thus, a need exists for an improved form of such contacts and contact arrays that can be fabricated in a less costly manner.

There is a well developed body of prior art contacts and contact arrays intended for test applications or for permanent interconnection of integrated circuits and other electrical devices on PC boards, as well as methods for making such contacts and contact arrays. For example, the following issued U.S. patents disclose such contacts, contact arrays and methods for making contacts or contact arrays, and represent, together with the above issued patent, the state of the art in the pertinent technology: U.S. Pat. No. 3,344,316, issued Sep. 26, 1967 to Stelmak; U.S. Pat. No. 3,596,228, issued Jul. 27, 1971 to Reed et al.; U.S. Pat. No. 3,877,051, issued Apr. 8, 1975 to Calhoun et al.; U.S. Pat. No. 4,089,575, issued May 16, 1978 to Grabbe; U.S. Pat. No. 4,351,580, issued Sep. 28, 1982 to Kirkman et al.; U.S. Pat. No. 4,548,451, issued Oct. 22, 1985 to Benarr et al.; U.S. Pat. No. 4,583,806, issued Apr. 22, 1986 to Tainter, Jr. et al.; U.S. Pat. No. 4,647,134, issued Mar. 3, 1987 to Nonaka; U.S. Pat. No. 4,747,784, issued May 31, 1988 to Cedrone; U.S. Pat. No. 4,789,345, issued Dec. 6, 1988 to Carter; U.S. Pat. No. 4,846,704, issued Jul. 11, 1989 to Ikeya; U.S. Pat. No. 4,927,369, issued May 22, 1990 to Grabbe et al.; U.S. Pat. No. 4,954,088, issued Sep. 4, 1990 to Fujizaki et al.; U.S. Pat. No. 5,015,191, issued May 14, 1991 to Grabbe et al.; U.S. Pat. No. 5,062,802, issued Nov. 5, 1991 to Grabbe; U.S. Pat. No. 5,071,359, issued Dec. 10, 1991 to Arnio et al.; U.S. Pat. No. 5,097,101, issued Mar. 17, 1992 to Trobough; U.S. Pat. No. 5,121,299, issued Jun. 9, 1992 to Frankeny et al.; U.S. Pat. No. 5,148,266, issued Sep. 15, 1992 to Khandros et al.; U.S. Pat. No. 5,158,467, issued Oct. 27, 1992 to Grabbe et al.; U.S. Pat. No. 5,173,055, issued Dec. 22, 1992 to Grabbe; U.S. Pat. No. 5,199,889, issued Apr. 6, 1993 to McDevitt, Jr.; U.S. Pat. No. 5,205,742, issued Apr. 27, 1993 to Goff et al.; U.S. Pat. No. 5,228,861, issued Jul. 20, 1993 to Grabbe; U.S. Pat. No. 5,273,440, issued Dec. 28, 1993 to Ashman et al.; U.S. Pat. No. 5,291,375, issued Mar. 1, 1994 to Mukai; U.S. Pat. No. 5,307,561, issued May 3, 1994 to Feigenbaum et al.; U.S. Pat. No. 5,308,252, issued May 3, 1994 to Mroczkowski et al.; U.S. Pat. No. 5,345,365, issued Sep. 6, 1994 to Herndon et al.; U.S. Pat. No. 5,347,086, issued Sep. 13, 1994 to Potter et al.; U.S. Pat. No. 5,376,010, issued Dec. 27, 1994 to Petersen; U.S. Pat. No. 5,380,210, issued Jan. 10, 1995 to Grabbe et al.; U.S. Pat. No. 5,418,469, issued May 23, 1995 to Turner et al. and U.S. Pat. No. 5,481,205, issued Jan. 2, 1996 to Frye et al.

Despite the existence of this prior art, a need still remains for an improved connector, connector system and method for making a connector. The present invention is directed to meeting that need.

SUMMARY OF THE INVENTION

Accordingly, it is an object of this invention to provide a connector and array incorporating the connector which is suitable for both electrical testing of electronic devices and for permanent connection to the electronic devices in a connector system.

It is another object of the invention to provide such a connector and array that can be fabricated in high volume production at low cost.

It is a further object of the invention to provide such a connector which is configured to provide an ideal contact region on contact elements of the connector.

It is still another object of the invention to provide a connector and process for making the connector which allows a contact force of the connector to be provided at a predetermined level, which can be readily adjusted to meet different requirements.

It is yet another object of the invention to provide a connector and array in which contact elements of the connector and array converge on a center of a contact cell made up of the contact elements.

It is a still further object of the invention to provide such a connector array in which selected cells of the array are readily connected together in a circuit arrangement.

The attainment of these and related objects may be achieved through use of the novel connector, connector system and method for making a connector herein disclosed. In accordance with one aspect of the invention, a connector in accordance with this invention has a contact structure including a substantially planar body of conductive material having upper and lower opposed contact surfaces. A contact cell comprises a portion of the planar body of conductive material. A plurality of contact element pairs are formed from the substantially planar body in the contact cell. At least one of the contact element pairs extends away from each of the upper and lower opposed contact surfaces.

In accordance with another aspect of the invention, a contact circuit system comprises a substantially planar body of conductive material having upper and lower opposed contact surfaces. A plurality of contact cells each comprise a portion of the planar body of conductive material. A first portion of the plurality of contact cells are electrically isolated from one another. A second portion of the plurality of contact cells are electrically connected.

In accordance with a further aspect of the invention, a method for making a contact structure comprises providing a substantially planar body of conductive material having upper and lower opposed contact surfaces. Upper and lower dielectric web layers are provided on the upper and lower opposed contact surfaces of the body of conductive material. An array of polygonal opposed openings is formed in the upper and lower dielectric web layers to define a plurality of contact cells in the body of conductive material. The contact cells are separated into a plurality of contact element pairs. The contact element pairs are deformed so that a first contact element pair extends through the upper dielectric web layer and a second contact element pair extends through the lower dielectric web layer.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
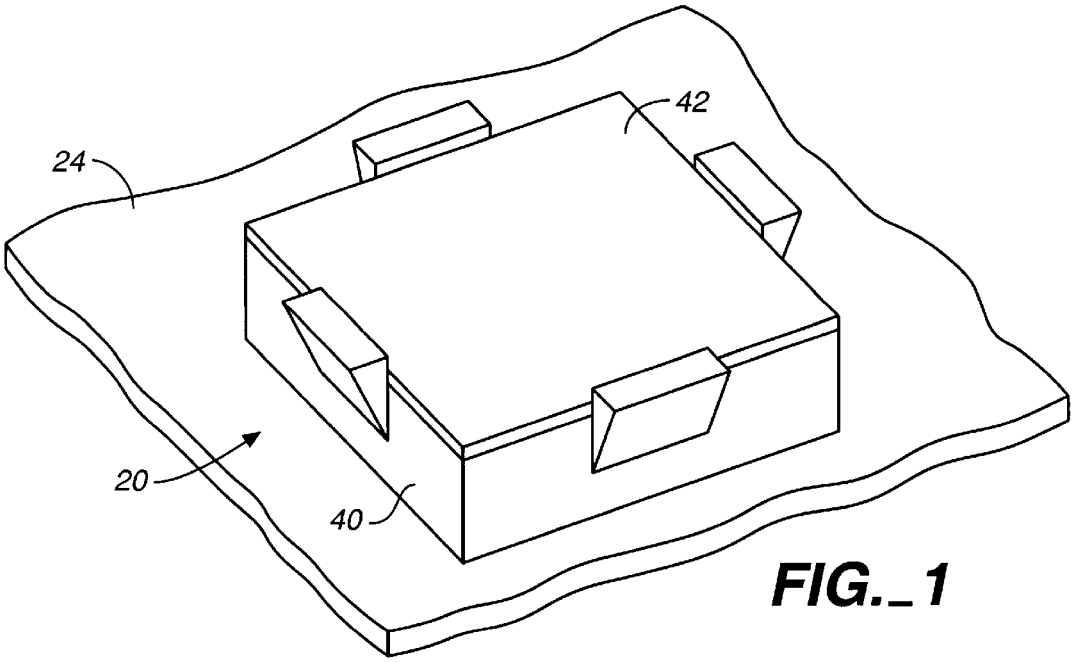
FIG. 1 is an external perspective view of a connector system in accordance with the invention.
Figure 3A:
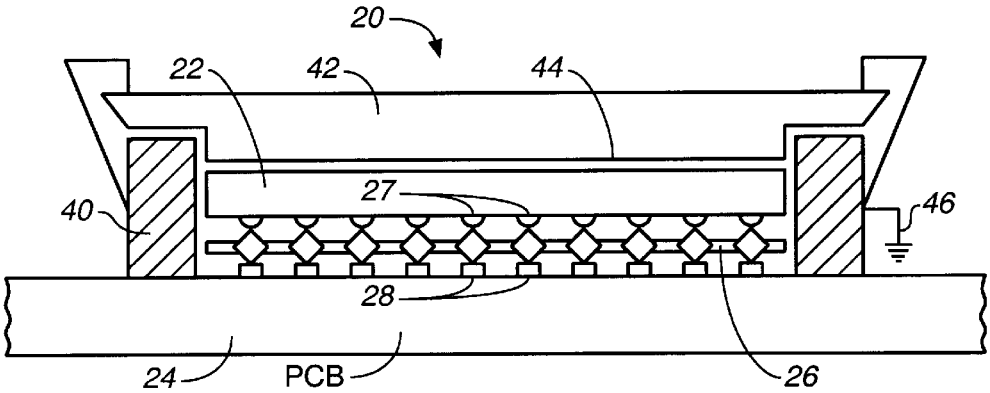
FIG. 3A is a side view of the connector system of FIGS. 1–2 in assembled form.
Figure 3B:
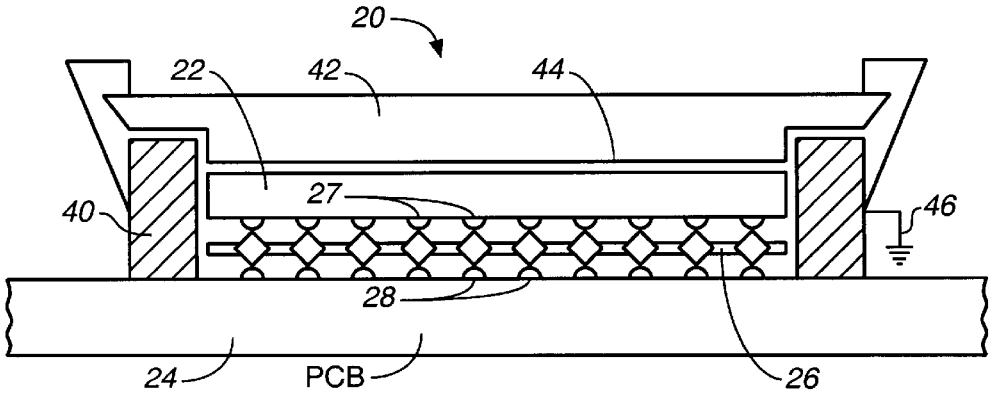
FIG. 3B is a side view of an alternative embodiment of the connector system in FIG. 3A.

Turning now to the drawings, more particularly to FIGS. 1–4C, there is shown a connector system 20 in accordance with the invention. As shown, a leadless integrated circuit (IC) device 22 is surface mounted to a printed circuit (PC) board 24 by means of a contact array 26 of this invention. The contact array 26 connects input-output (I/O) contacts 27 on the IC device 22 to corresponding circuit contacts 28 on PC board 24. In FIG. 3A, the contacts 28 on the PC board are shown as planar in configuration, and in FIG. 3B, they are shown as bump contacts 28, corresponding in configuration to the contacts on the IC device 22.

Figure 2:
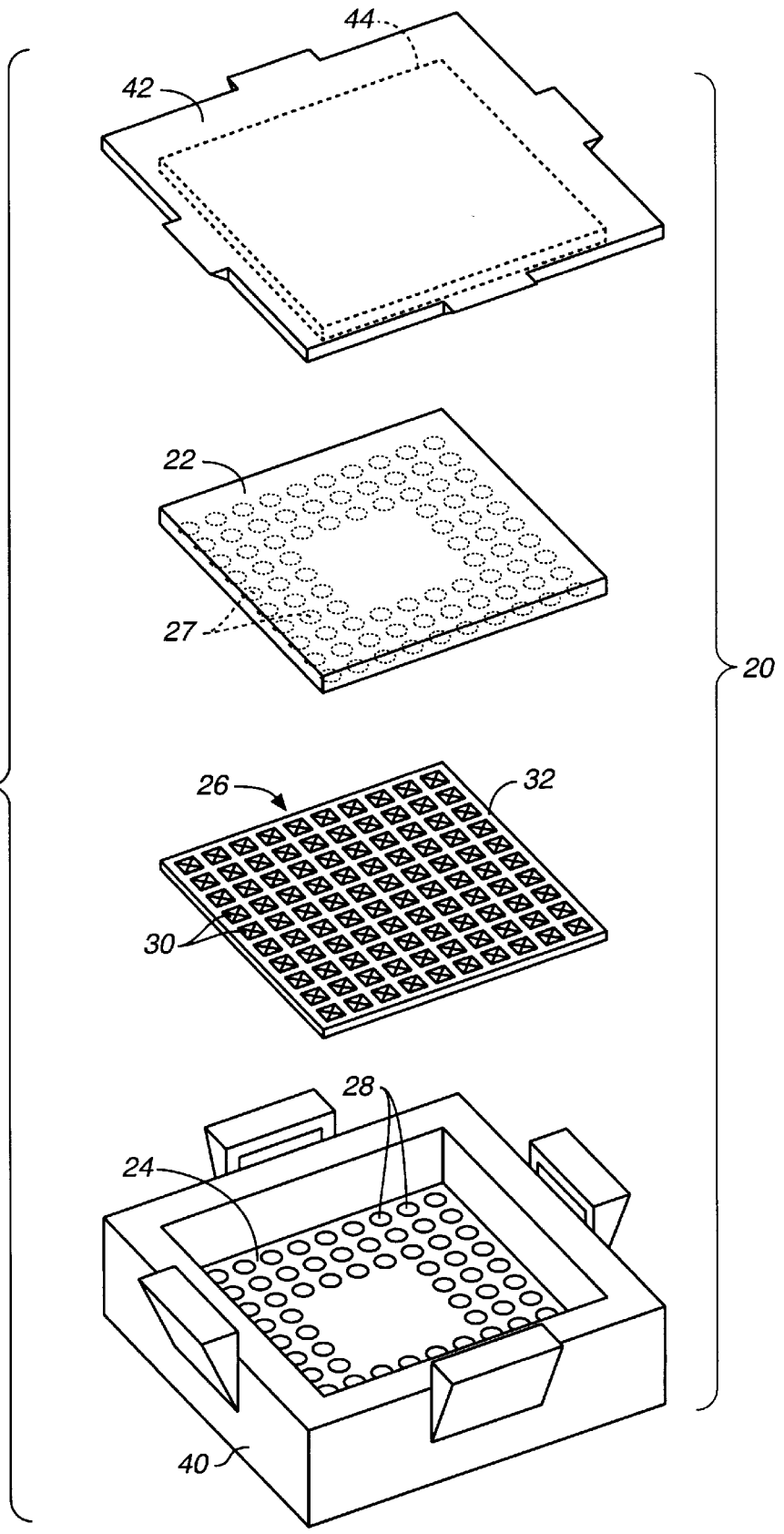
FIG. 2 is an exploded perspective view of the connector system shown in FIG. 1.
Figure 4A:
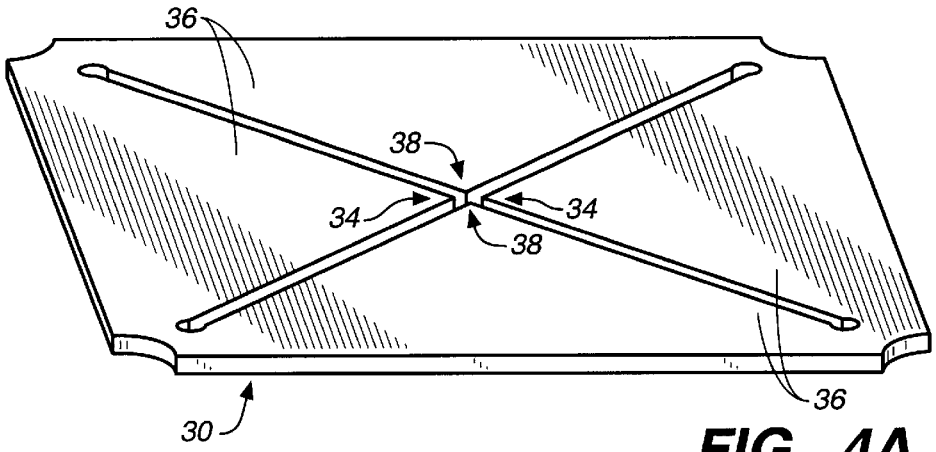
FIGS. 4A–4D are enlarged perspective views of a portion of the connector system shown in FIGS. 1–3A.
Figure 4B:
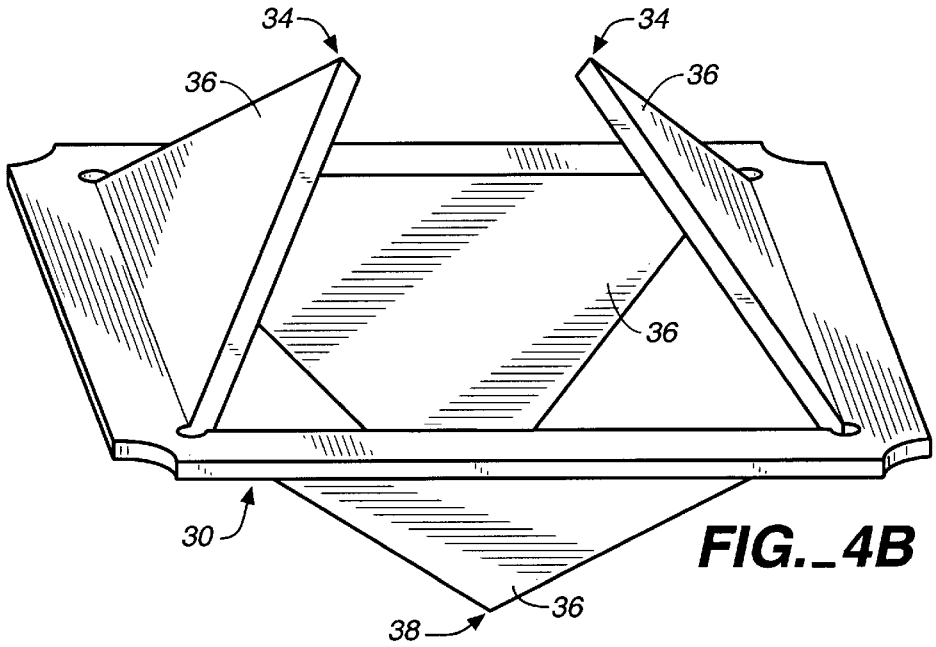
Figure 4C:
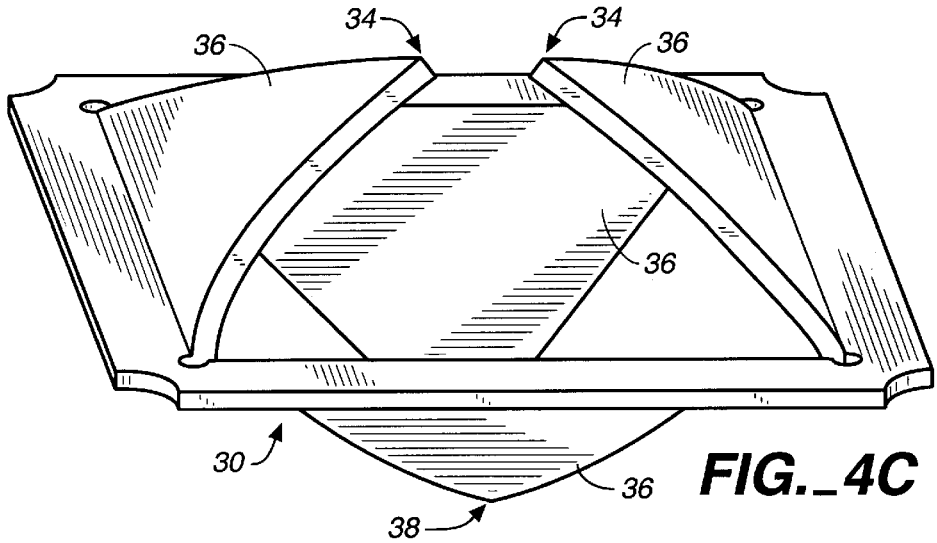

The contact array 26 is a generally thin, flexible and rectangular shaped element that is sandwiched between the PC board 24 and the IC device 22. As is best shown in FIG. 2, the contact array 26 has a plurality of square cells 30 that are each a portion of the array 26 and are formed from a planar body 32 of a suitable conductive material, such as beryllium copper, sandwiched between suitable insulating films, formed from polyimide. As will be apparent from the discussion of FIGS. 5A–5C below, the square cells 30 are defined by mated openings on either side of the conductive material layer in the insulating films. As is best shown in FIGS. 4A–4C, each cell is divided into a first pair 34 of contact elements 36 extending above the plane of the body 32 and a second pair 38 of contact elements 36 extending below the plane of the body 32. The square cells 30 could also be rectangular or otherwise polygonal in shape. With a polygonal shape having more than four sides, more than two contact pairs 34 and 38 are present.

In order to provide a suitable contact force between the PC board 24 and the IC device 22, a metal frame 40 is positioned around the array 26 and a cover plate 42 having a bottom plug 44 is clamped in position over the metal frame 40 so that the bottom plug 44 presses the IC device 22 against the contact array 26. If desired, the metal frame 40 can be grounded as shown at 46 to serve as a Faraday cage around the IC device 22.

Figure 5A:
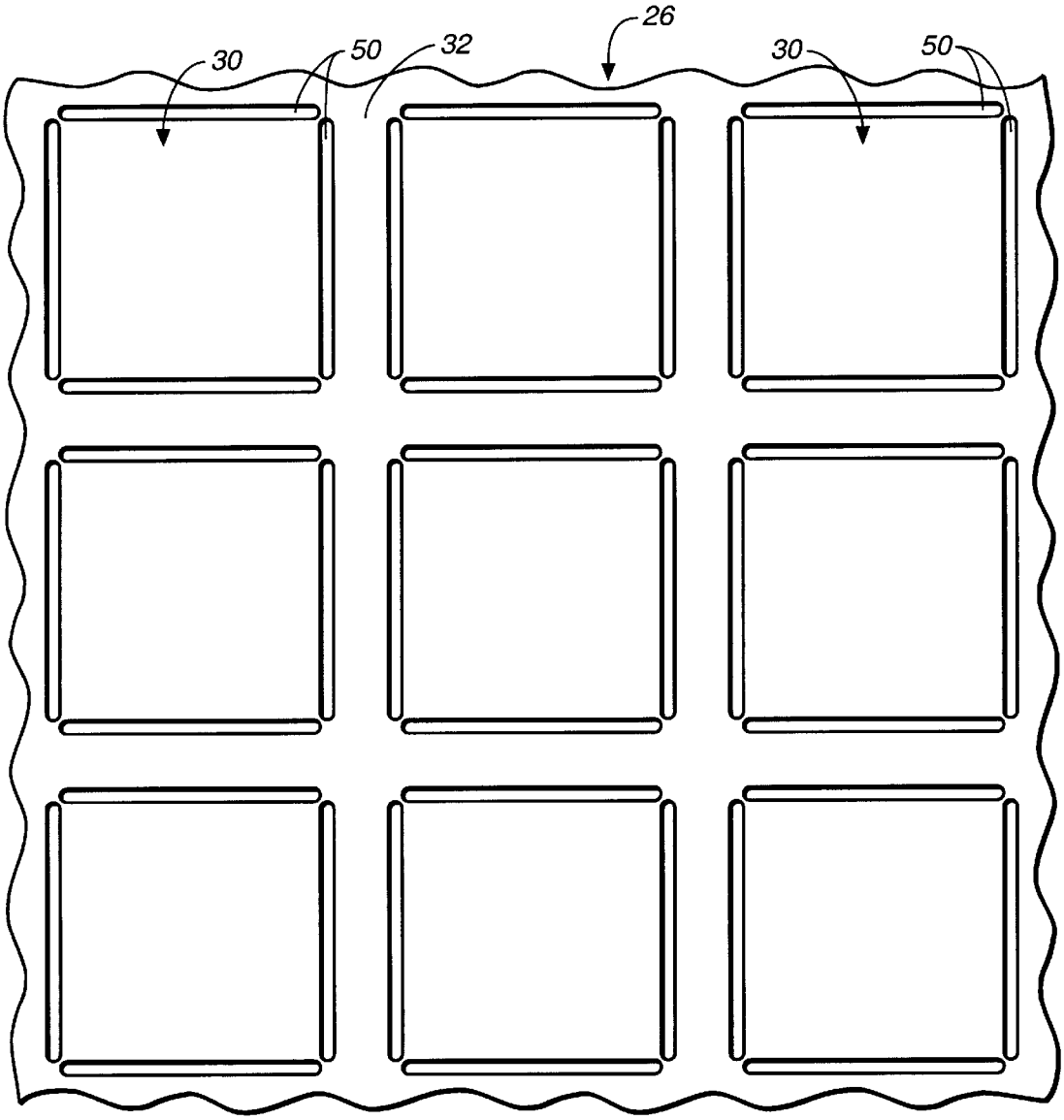
FIGS. 5A–5C are plan views of portions of the connector system shown in FIGS. 4A–4D in different stages of fabrication.
Figure 5B:
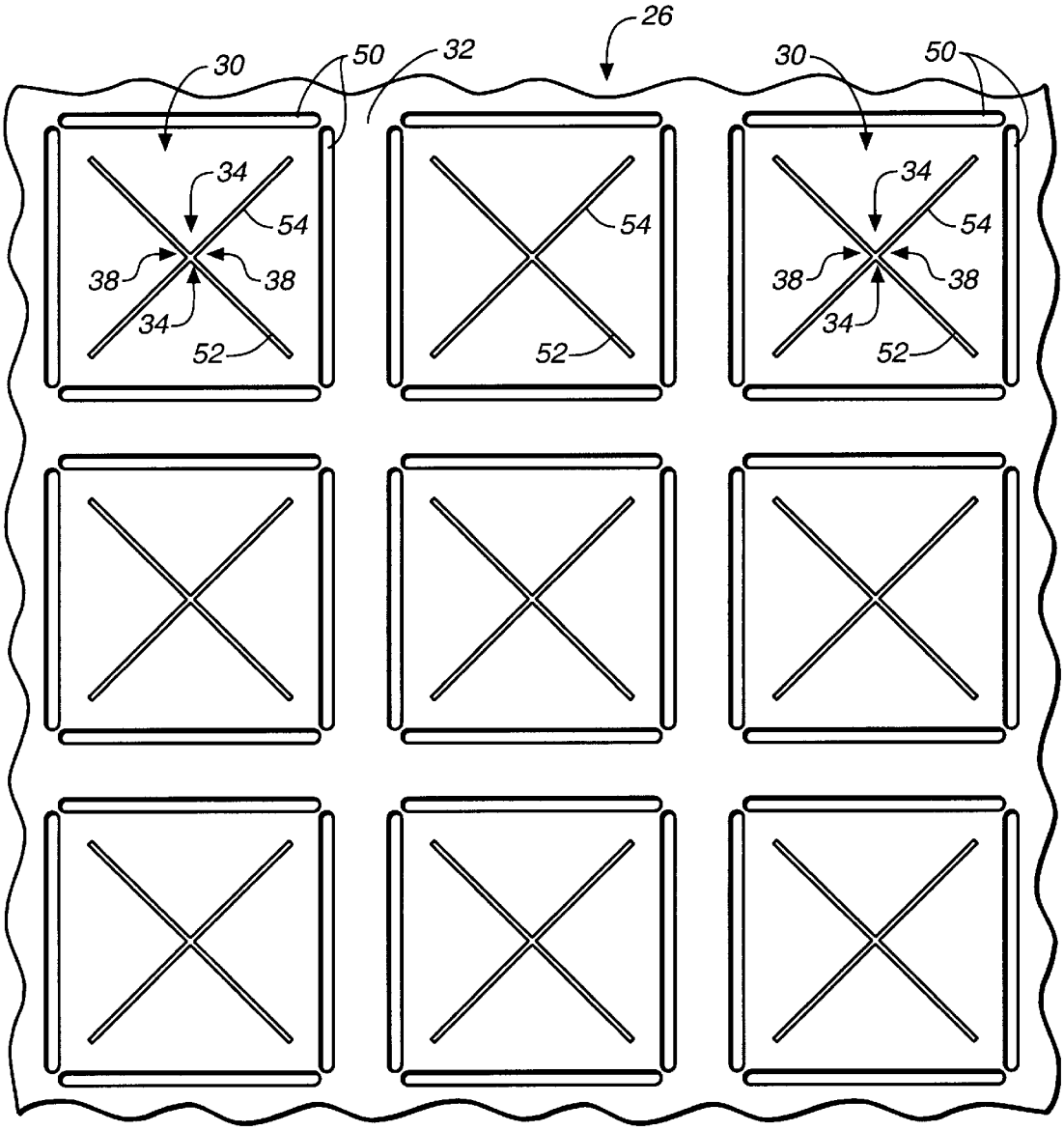
Figure 5C:
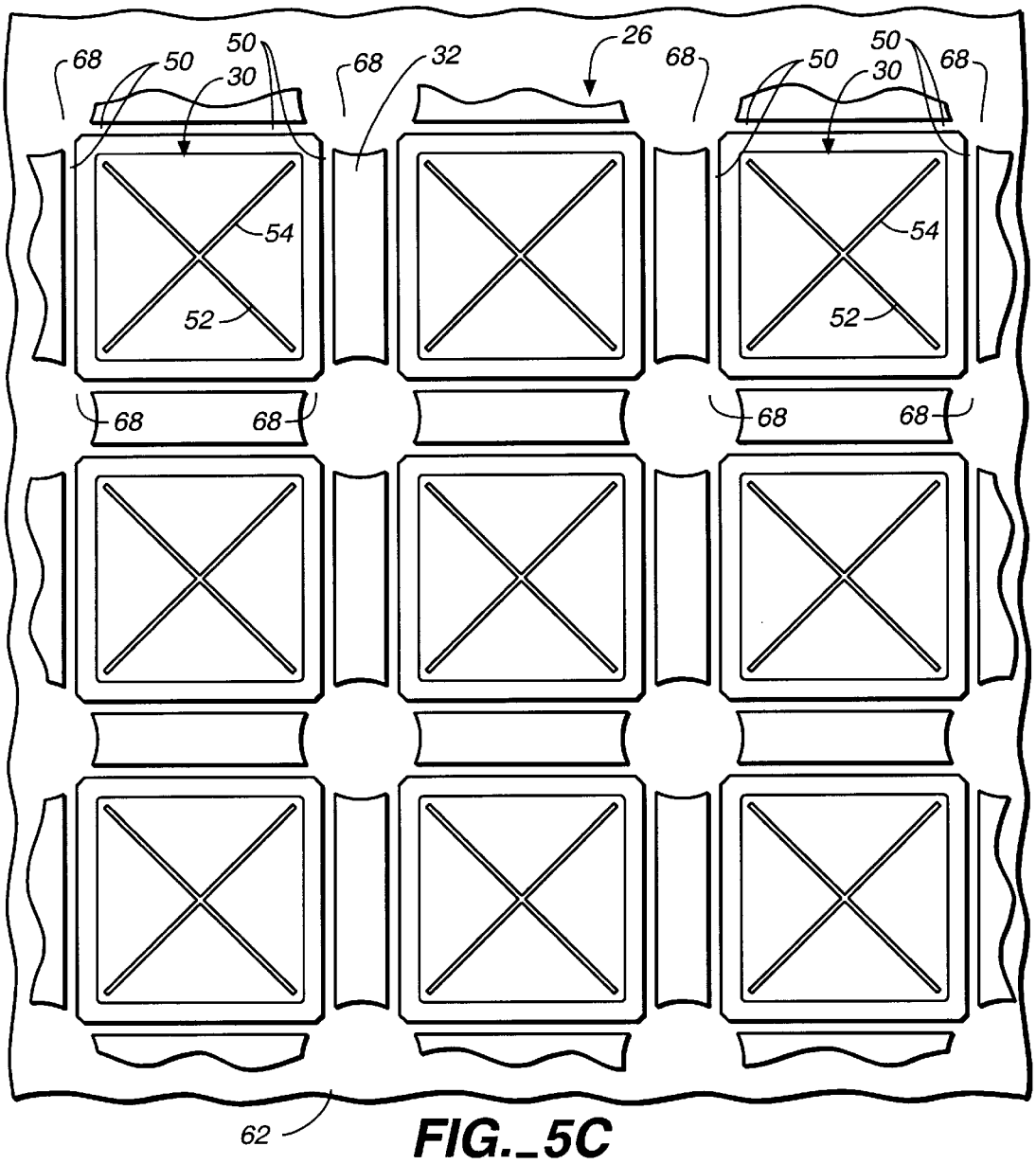
Figure 5D:
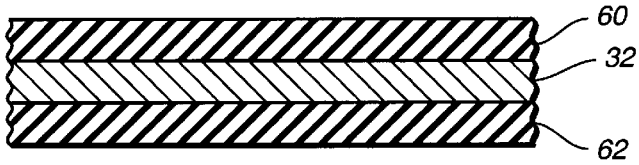
FIG. 5D is an enlarged fragmentary view in cross-section of the planar material which is comprised of the planar conductive layer or body in which conductor cells are formed and the insulating layers on each side of the conductive layer.

FIGS. 5A–5C show cells 30 during a series of steps in manufacture of the array 26 and after packaging as shown in FIGS. 1 and 3. Each cell 30 is formed from a portion of the planar body 32. A plurality of edge apertures 50 are formed by a stamping or etching process to define the edges of the cells 30 (see FIG. 5A). Intersecting laser cuts 52 and 54 are formed in the planar body 32 to define the contact element pairs 34 and 38. Upper and lower cell openings are formed in the insulating layers at each cell 30 by a suitable etching process. Corner apertures 68 are formed through the insulating layers 60 and 62 and the planar body 32 to connect the edge apertures 50 around each cell 30, to isolate the cells 30 electrically from one another.

Figure 6A:
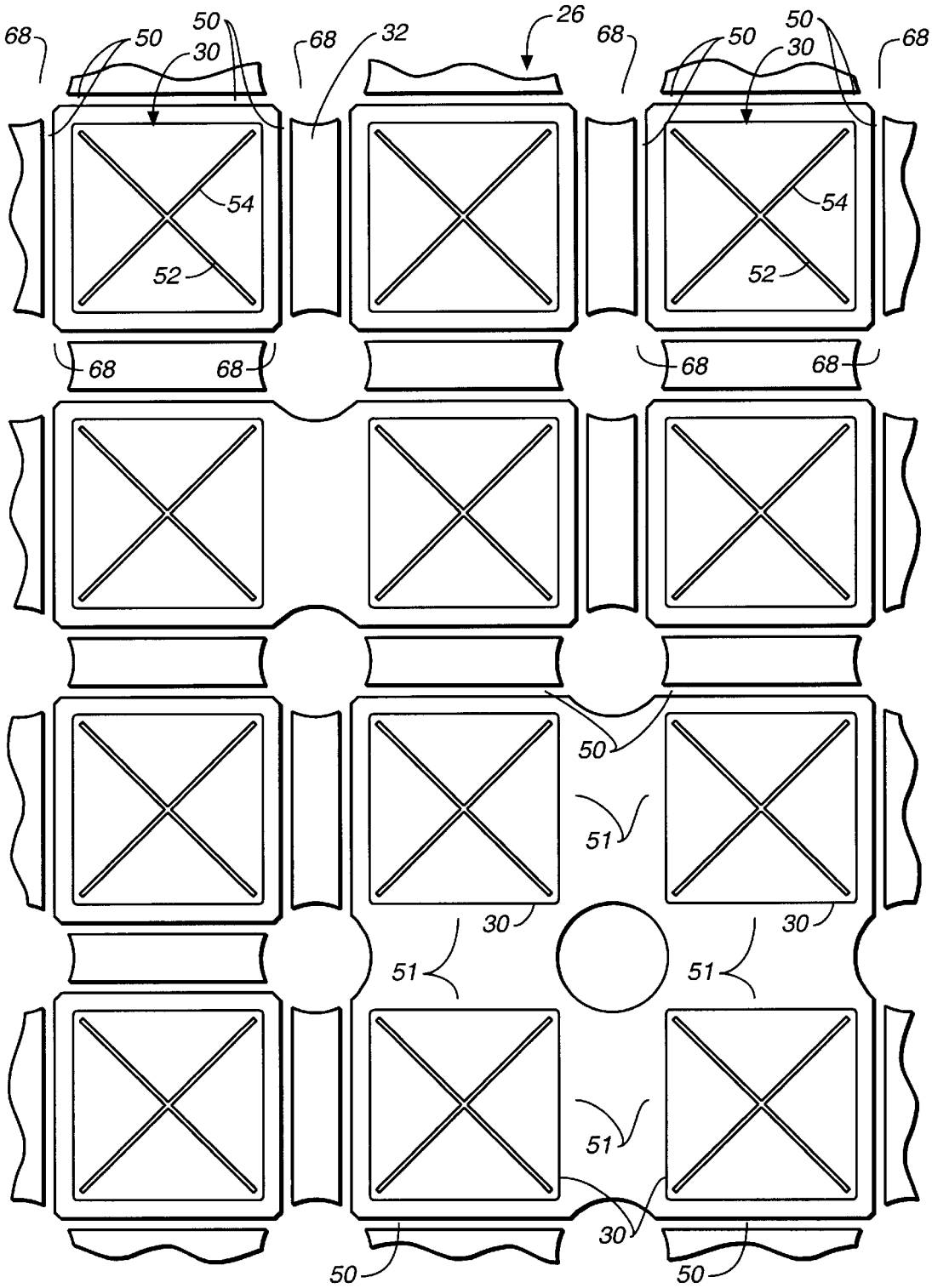
FIGS. 6A–6B are plan views of portions of two further embodiments of a connector system in accordance with the invention.
Figure 6B:
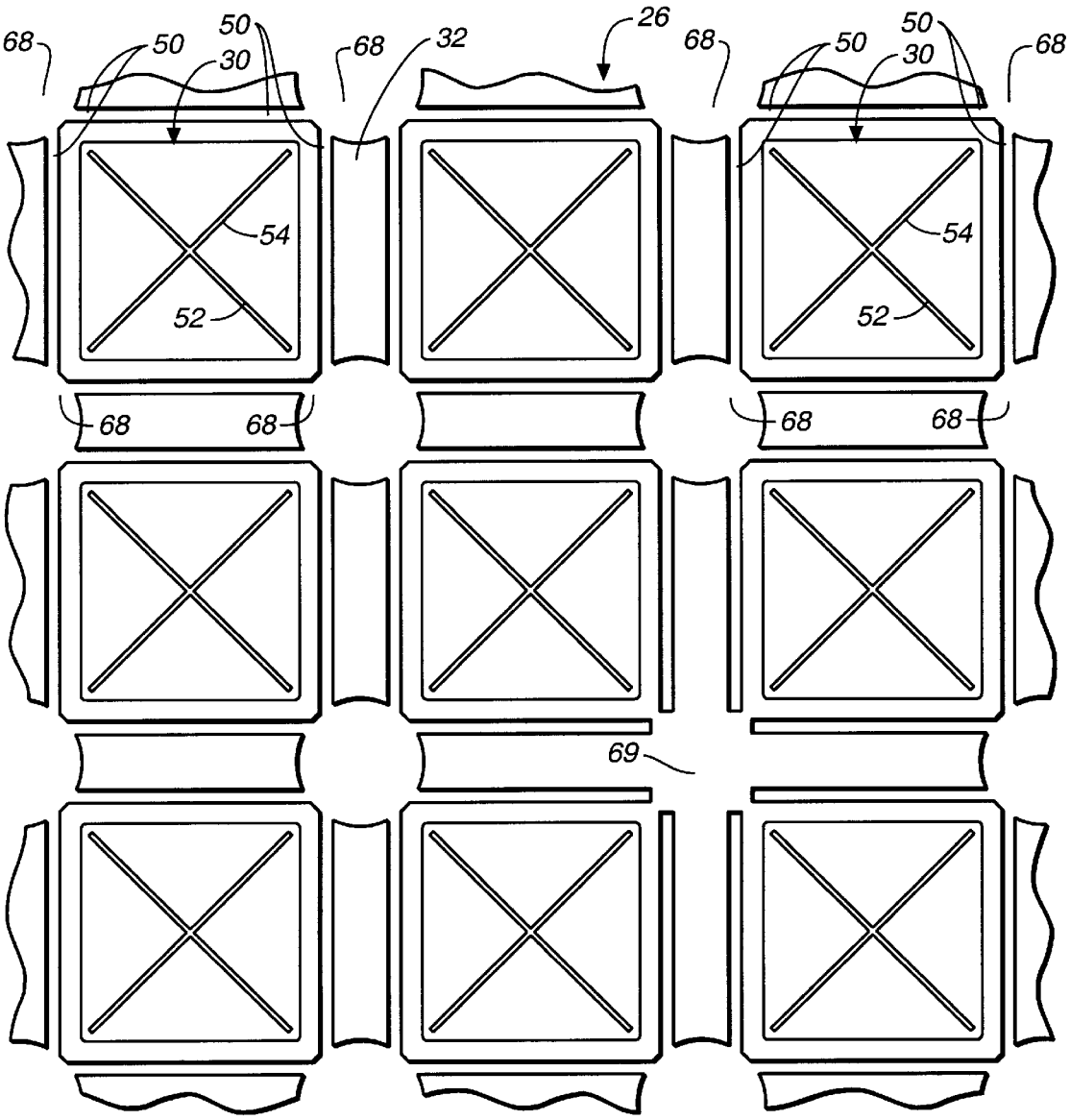

If desired, selective interconnection of a chosen group or group of cells 30 can be achieved in two ways, which are respectively shown in FIGS. 6A and 6B. In FIG. 6A, the edge apertures 50 are selectively omitted at 51 around the group of cells 30 in the lower right hand portion of FIG. 6A that are to be connected together in a circuit arrangement. In FIG. 6B, a corner aperture 68 has been omitted at 69 in order to connect a corresponding group of cells 30 together. FIG. 6B is a preferred embodiment, because omitting the corner aperture rather than edge apertures has much less effect on the mechanical properties of the cells 30 that are connected together in this manner than eliminating edge apertures 50.

Figure 4D:
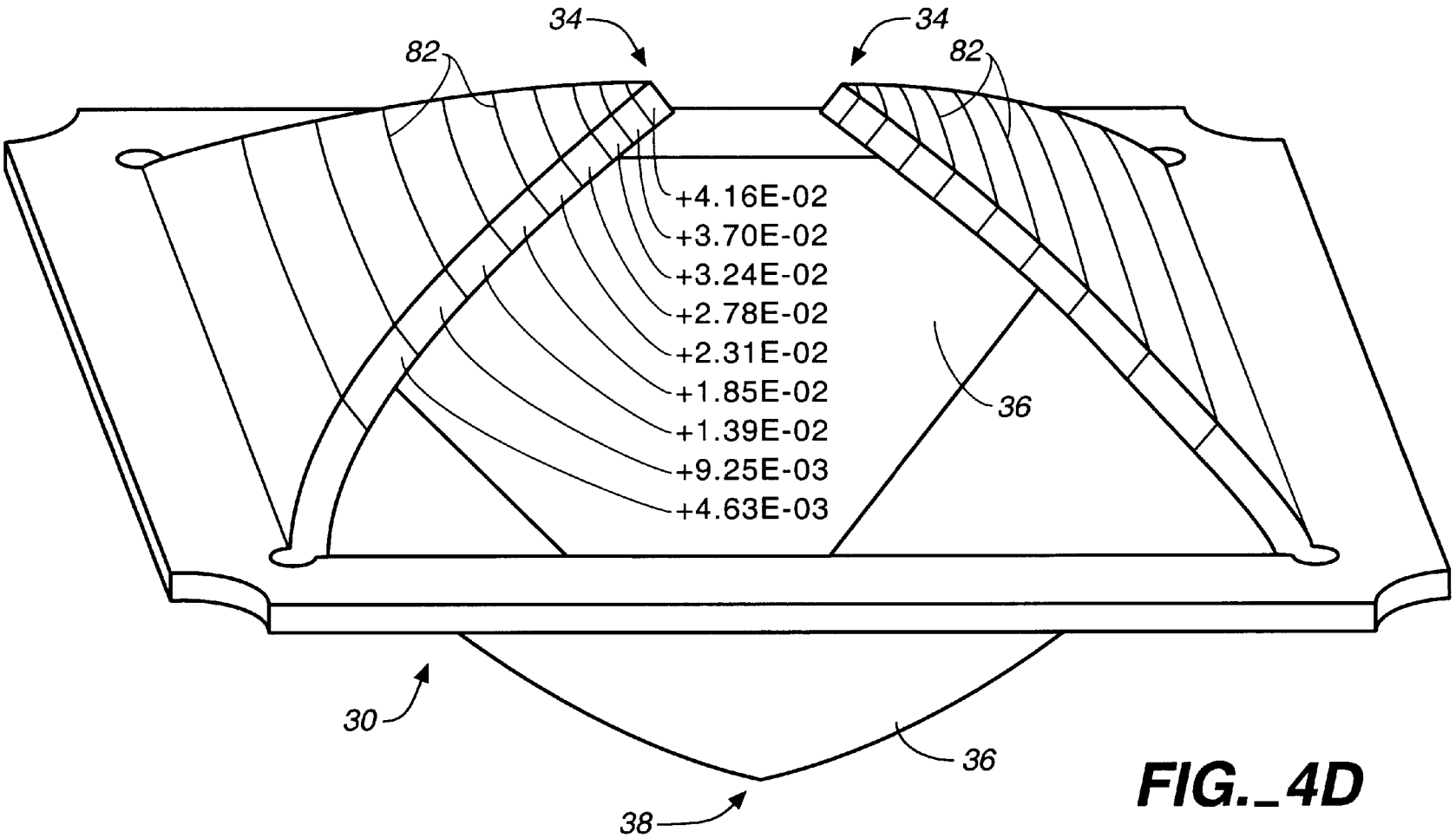

The contact pairs 34 and 38 are now respectively deformed upwardly and downwardly to the positions shown in FIGS. 4B–4D and FIG. 6A, using suitable mandrels. In use, when electrical contact is made between the IC device 22 and the PC board 24, the contact pairs 34 and 38 are bowed as shown in FIG. 4C and 4D by the contact force applied between the IC device 22 and the PC board 24. FIG. 4D shows mechanical stress patterns represented by lines 82 formed in the contact elements 36 when they are bowed to the positions shown in FIGS. 4C and 4D. The numerical values represent the extent of deflection of each area defined by the lines 82. The contact force obtained when the contact elements 36 are deflected can be varied to desired values by choosing different thicknesses for the metal of the planar body. The contact force on deflection can also be varied by perforating the planar body at the bases (or bend lines) of the contact element triangles to a greater or lesser extent.

Figure 7:
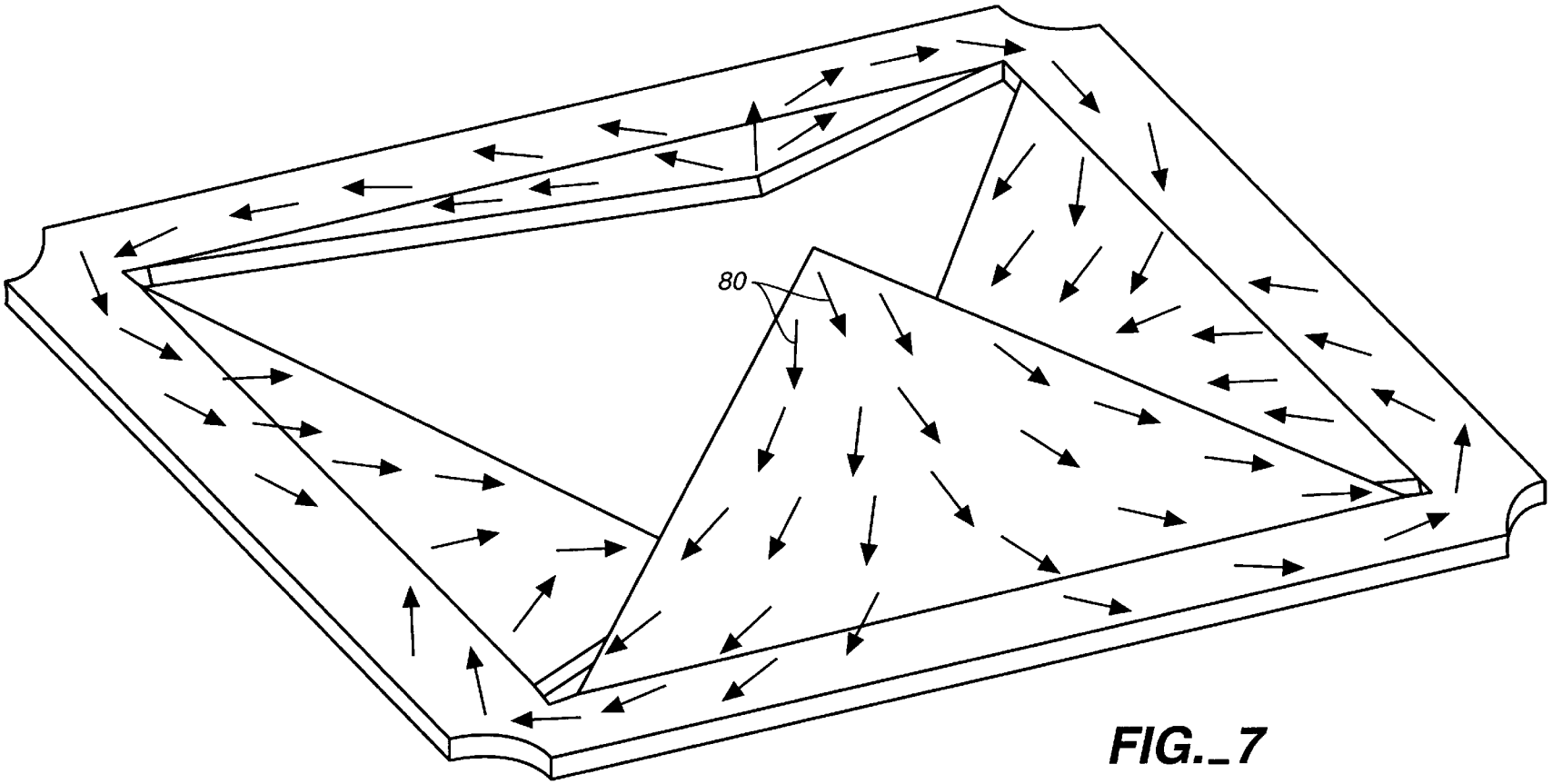
FIG. 7 is an enlarged perspective view of the portion of the connector system shown in FIGS. 4A–4D showing current flow patterns.
Figure 8:
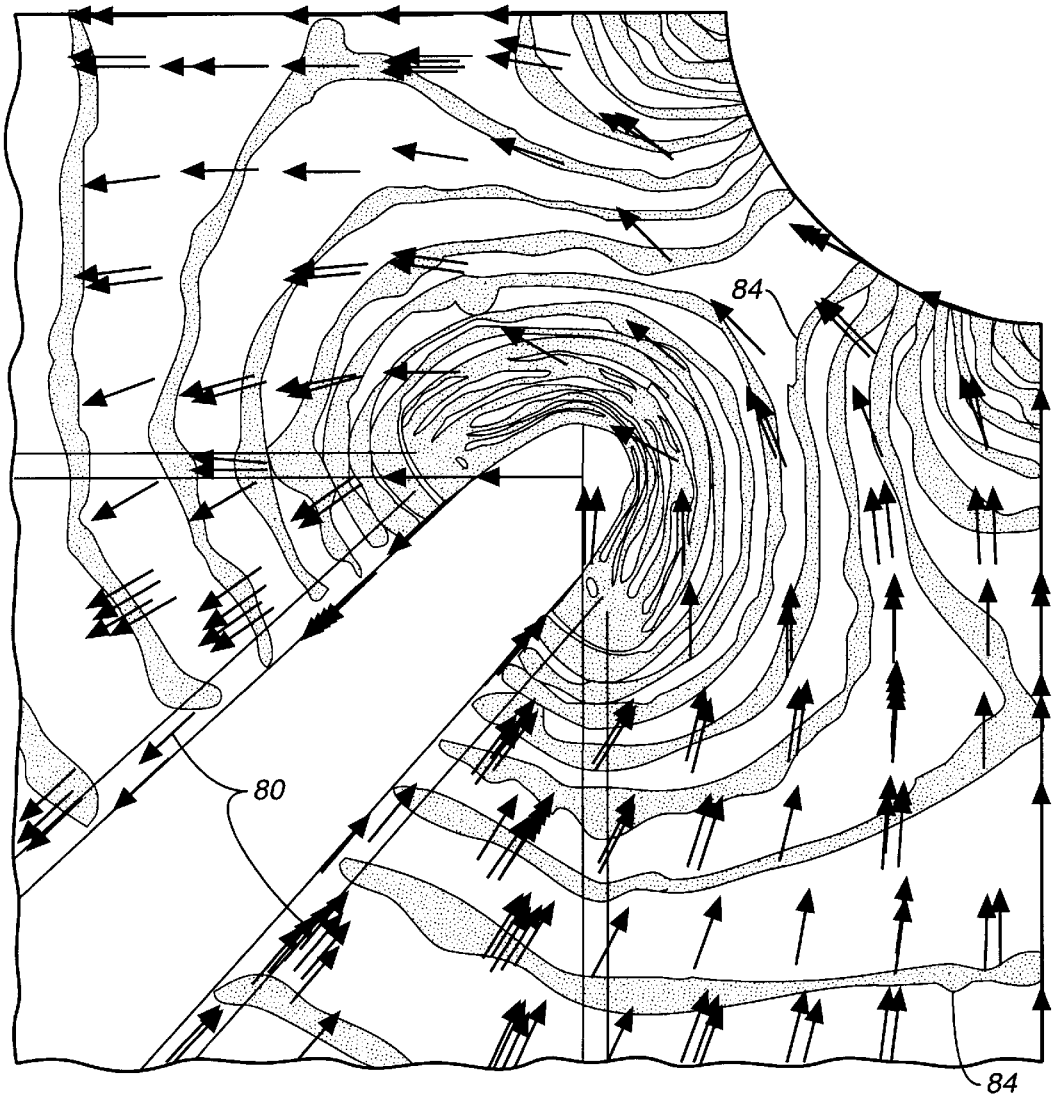
FIG. 8 is an enlarged plan view of the area 8 shown in FIG. 7, further showing current flow patterns and current flux density.
Figure 9:
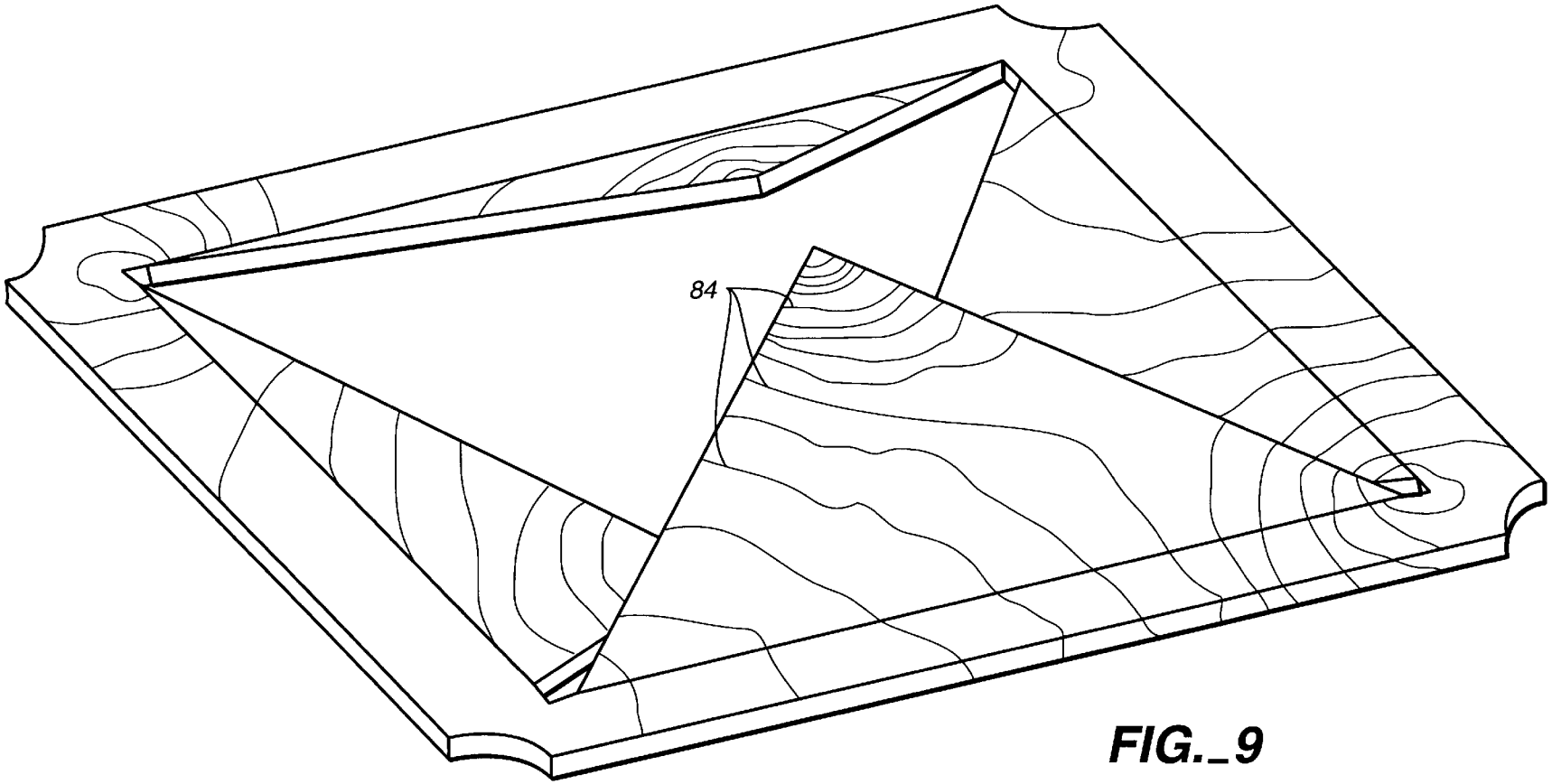
FIG. 9 is another enlarged perspective view of the portion of the connector system similar to that shown in FIG. 9, but showing current flux density.

FIGS. 7 and 8 show current flow directions, represented by arrows 80, in the contact pairs 34 and 38. FIGS. 8 and 9 show current density flux patterns or lines 84. As shown, a relatively low current density gradient is obtained in the contact elements 36 as a result of the triangular shape of the contact elements and the avoidance of constricted regions along the bases of the triangles.

Figure 10:
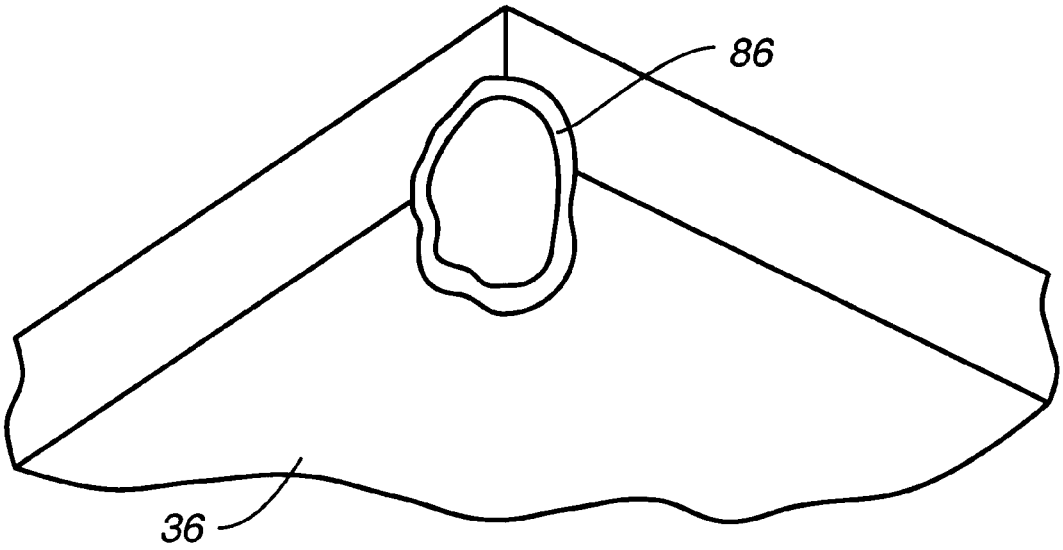
FIG. 10 is an enlarged perspective view of a part of the connector system portion shown in FIGS. 7 and 9.
Figure 11:
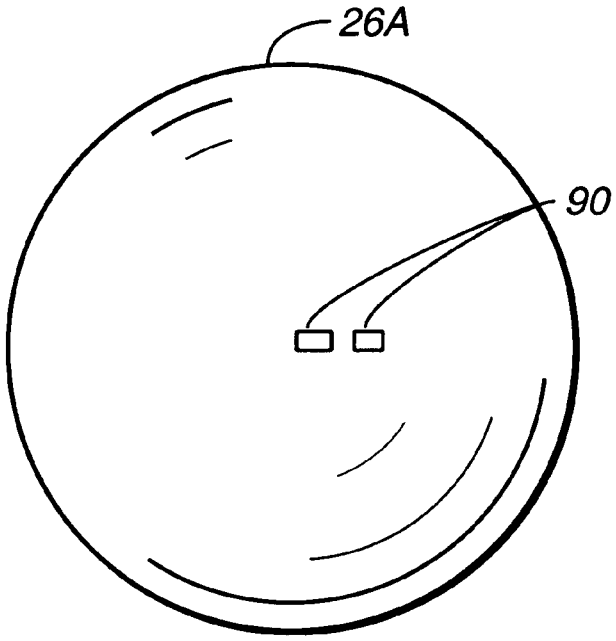
FIG. 11 is an enlarged plan view of a contact pad on an IC device with which the connector system of the invention is used.

FIG. 10 shows a contact area 86 formed when the tip of a contact element 36 engages a contact pad 88 (FIG. 11) on an IC device 22 in use of the array 26. The tips of the contact elements 36 form a pair of marks 90 on the contact pad 88. Similar marks are obtained on the contact areas of the PC board.

Figure 12:
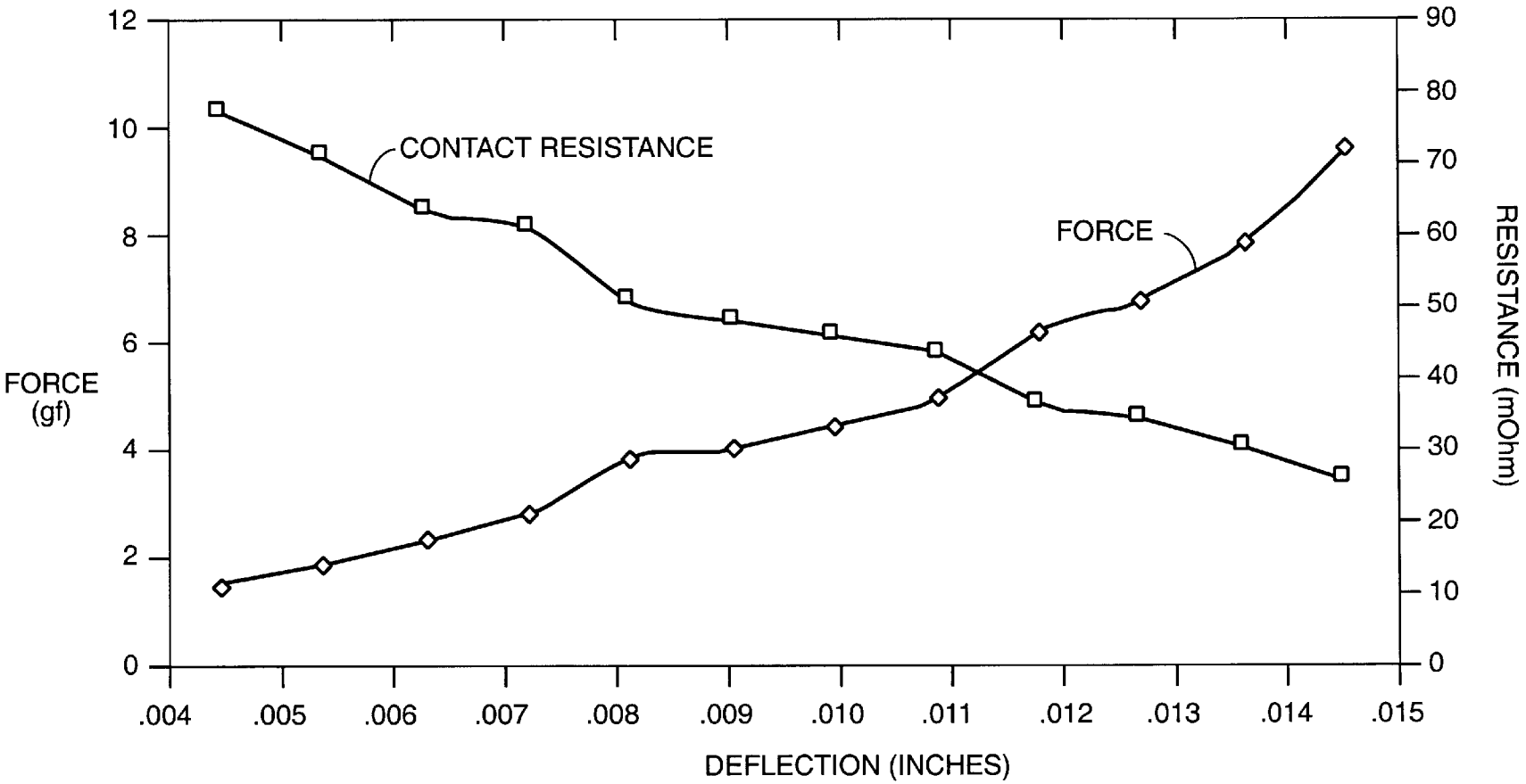
FIG. 12 is a graph showing a relationship between contact force and contact resistance obtained with the connector system of FIGS. 1–10.

FIG. 12 shows that, as contact force varies from about 2 g to about 10 g, contact resistance decreases from about 80 mOhms to about 25 mOhms. Corresponding deflection of the contact elements 36 is shown on the x axis of the graph.

It should now be readily apparent to those skilled in the art that a novel connector, connector system and method of making the connector capable of achieving the stated objects of the invention has been provided. The connector and array incorporating the connector is suitable for both electrical testing of electronic devices and for permanent connection to the electronic devices in a connector system. The connector and array that can be fabricated in high volume production at low cost. The connector is configured to provide an ideal contact region on contact elements of the connector. The connector and process for making the connector allows a contact force of the connector to be provided at a predetermined level, which can be readily adjusted to meet different requirements. The connector and array has contact elements which converge on a center of a contact cell made up of the contact elements. Individual contact cells are readily selectively connected together in desired circuit patterns.

It should further be apparent to those skilled in the art that various changes in form and details of the invention as shown and described may be made. It is intended that such changes be included within the spirit and scope of the claims appended hereto.

What is claimed is:

1. A contact structure comprising:

a substantially planar body of conductive material having oppositely facing upper and lower contact surfaces; and a contact cell formed in said planar body of conductive material;

said contact cell including at least two pairs of opposed contact elements which converge at a center of said contact cell, two of the contact elements of said pairs of contact elements extending away from the upper contact surface of said planar body of conductive material, and the other two of the contact elements of said pairs contact elements extending in the opposite direction away from the lower contact surface of said planar body of conductive material.

2. The contact structure of claim 1 in which said contact cell is polygonal in shape.

3. The contact structure of claim 2 in which said contact cell is generally rectangular in shape.

4. The contact structure of claim 2 in which said contact element pairs are generally triangular in shape and have triangular-shaped points that converge at the center of said contact cell.

5. The contact structure of claim 1 in which both contact elements of one of said pairs of contact elements extend away from the upper contact surface of said planar body of conductive material, and both contact elements of the other of said pairs of contact elements extends in the opposite direction away from the lower contact surface of said planar body of conductive material.

6. The contact structure of claim 5 in which said contact element pairs are generally triangular in shape and have triangular-shaped points that converge at the center of said contact cell.

7. An array of contact structures comprising:

a substantially planar material having a conductive layer and at least one insulating layer; and a plurality of contact cells formed in conductive layer of said planar material, each of said contact cells including at least two pairs of opposed contact elements which converge at a center of said contact cell, two of the contact elements of said pairs of contact elements extending away from the upper contact surface of said planar body of conductive material, and the other two of the contact elements of said pairs of contact elements extending in the opposite direction away from the lower contact surface of said planar body of conductive material;

the insulating layer of said planar material acting to hold said contact cells in a pre-determined array and to provide electrical isolation between said cells.

8. The array of claim 7 in which said plurality of contact cells are formed by a plurality of isolation apertures in the conductive layer of said planar material for separating adjacent contact cells.

9. The array of claim 8 in which each of said contact cells is defined by perimeter edges, and said isolation apertures include edge apertures extending between adjacent edges of said contact cells and corner apertures intersecting with said apertures.

* * * * *